US006443309B1

(12) United States Patent
Becker

(10) Patent No.: US 6,443,309 B1
(45) Date of Patent: Sep. 3, 2002

(54) APPARATUS FOR PACKAGING GOODS

(75) Inventor: John W. Becker, Gardena, CA (US)

(73) Assignee: Victory Packaging, Inc., Houston, TX (US)

( * ) Notice: Subject to any disclaimer, the term of this patent is extended or adjusted under 35 U.S.C. 154(b) by 0 days.

(21) Appl. No.: 09/572,541

(22) Filed: May 15, 2000

(51) Int. Cl.[7] ..... B65D 81/02
(52) U.S. Cl. ..... 206/594; 220/592.2; 383/110
(58) Field of Search ..... 206/521, 591, 206/592, 594; 220/592.2, 592.26; 383/98, 99, 109, 110, 122

(56) References Cited

U.S. PATENT DOCUMENTS

| | | | | | |
|---|---|---|---|---|---|
| 2,392,206 | A | * | 1/1946 | Waters | 383/122 |
| 3,024,935 | A | * | 3/1962 | Vinick | 206/594 |
| 4,041,851 | A | * | 8/1977 | Jentsch | 383/122 |
| 4,704,731 | A | * | 11/1987 | Katase et al. | 383/122 |
| 4,929,094 | A | * | 5/1990 | Becker | 383/110 |
| 5,820,268 | A | | 10/1998 | Becker et al. | |
| 6,007,467 | A | | 12/1999 | Becker et al. | |
| 6,139,188 | A | * | 10/2000 | Marzano | 383/110 |

* cited by examiner

*Primary Examiner*—Luan K. Bui
(74) *Attorney, Agent, or Firm*—Charles H. Thomas

(57) ABSTRACT

A fully collapsible shipping container is comprised of it least one sheet of a flexible, thermally insulating material. The sheet or sheets of material have mutually parallel linear side edge fastening margins. The sheet or sheets are folded to form a rectangular floor and four walls projecting from the floor in orthogonal relationship relative thereto to define an enclosure. The linear side edge fastening margins meet at and are heat sealed throughout interfaces of mutual contact. The side edge margins are directed outwardly from the interior of the enclosure. The heat seals formed by the two layers of material at the edge fastening margins are leak proof so that moisture cannot escape from perishable food products shipped within the container. A container can be formed from a single sheet of plastic bubble packing material or from material lined with a plastic film and shaped so that the container will fit within an outer corrugated paper board box. Alternatively, a container can be formed from a single sheet of plastic bubble packing material having a metallic reflective layer on its outside surface to accommodate an inner corrugated paper board box placed within the container enclosure. In still another embodiment the container is formed of several sheets of moisture impervious material having fastening edge margins that are heat sealed together to form a leak proof enclosure.

9 Claims, 16 Drawing Sheets

APPARATUS FOR PACKAGING GOODS

BACKGROUND OF THE INVENTION

1. Field of the Invention

The present invention relates to a system for leakproof packaging of goods, particularly perishable food products.

2. Description of the Prior Art

Various types of container systems have been utilized to package perishable goods, such as food products. The packaging of food products for shipment in compartmentalized containers presents several problems, the solutions to which are sometimes in conflict. It is highly desirable for perishable food to be shipped in containers that provide a high degree of cushioning to prevent damage to the food products that would otherwise result from the impacts to the containers that inevitably occur during loading and unloading, and during transportation on a vehicle. Unfortunately, many of the best cushioning systems are quite bulky, thereby reducing the quantity of perishable goods that can be packed within a limited volume of space.

Another conflict in packaging of perishable goods that exists involves the matter of protection from leakage. While it is entirely possible to devise leakproof containers, many conventional leakproof packages are quite bulky. Some are also quite heavy. Nevertheless, unless the packages are rendered leakproof, the escape of moisture damages outer shipping cartons in which the goods are packaged, which can easily lead to damage to the food products during unloading. Such leakage also creates messes in the transport vehicles and in storage areas. These messes must be cleaned up, thus increasing the labor expense involved in shipping and storage.

Another problem that exists in packaging perishable food products for shipment is that the empty containers that are used to protect the goods during shipment present a storage problem when they are not actually in use. To solve this problem I previously devised an insulated container for packaging perishable goods which is fully collapsible so that large numbers of these containers can be stored within a compact volume. These containers, and their construction, are described in my prior U.S. Pat. Nos. 5,820,268 and 6,007,467.

However, I have since discovered certain shortcomings in my prior design. Specifically, these container devices involve seams between adjacent abutting edges that are secured by tape or edge line heat sealing. In both of these sealing systems the edges of a sheet of material that must be joined are brought together in abutting relationship and then sealed. Unfortunately, edges sealed in this manner are drawn apart by stress at their junction so that leakage occurs with disturbing frequency. Also, both the collapsing and deployment of these containers requires a number of steps of manual manipulation. While such steps can be performed rather quickly on a single container, the time required is unacceptably great when a large number of these containers must be deployed for use or collapsed following use.

SUMMARY OF THE INVENTION

The present invention provides an extremely useful and simple container for shipping perishable goods that overcomes many of the difficulties of prior devices employed for this purpose. In one broad aspect the present invention may be considered to be a collapsible shipping container comprising at least one sheet of flexible, thermally insulating material having mutually parallel linear side edge fastening margins. The sheet or plurality of sheets are folded to form a rectangular floor and four walls projecting from the floor in orthogonal relation relative to the floor to define an enclosure. The linear side edge fastening margins meet in facing relationship and are heat sealed throughout interfaces of mutual contact, whereby the edge margins are directed outwardly from the exterior of the enclosure.

The sheet or sheets of material used in the fabrication of the collapsible shipping container of the invention are preferably formed of plastic, white, bubble packing material faced on both sides with plastic film layers. This material provides very good thermal insulating properties, is impervious to moisture, and creates a very good overall insulating effect without occupying a great volume of space. One suitable alternative construction may employ sheet material formed of a plastic foam layer faced on one side with a plastic film layer.

Preferred embodiments of the invention may take several forms. In one preferred embodiment the shipping container is comprised of first, second, and third sheets of material as previously described. The first sheet has an elongated shape with mutually parallel side edge margins and mutually opposing end sections with a center section located therebetween. The second and third sheets of material are shorter than the first sheet and both have bottom attachment edge margins that are heat sealed to opposing ones of the side edge margins of said first sheet at said center section thereof. The second and third sheets have side edge margins extending perpendicular to the side edge margins of the first sheet. The side edge margins of the second and third sheets are heat sealed to the side edge margins of the first sheet which together form the aforesaid linear side edge fastening margins. The end sections of the first sheet and the second and third sheets form the four walls and the center section of the first sheet forms the floor of the collapsible shipping container of the invention.

In the foregoing embodiment which is formed of three sheets joined together the floor is foldable inwardly toward the enclosure along a floor folding line that bisects the floor and extends between the second and third sheets. The second and third sheets are both foldable inwardly toward the enclosure along wall folding lines that are parallel to the side edge margins of the second and third sheets and which are equidistant therefrom. In this way the floor is foldable in half and the end sections of the first sheet are collapsible into contact with each other.

Preferably, one of the first sheet end sections is longer than the other and thereby forms a flap that folds over a portion of the other first sheet end section. The provision of a closure flap makes it easier to seal the container and preserve liquid tight integrity of the container and the freshness of food products encapsulated therein.

In another embodiment of the invention the collapsible shipping container is formed from a single, elongated, rectangular sheet of flexible, thermally insulating material having the side edge fastening margins in the direction of its length and delineated into a larger panel and a smaller panel. The smaller panel forms a pouch apron end section which is folded back against the larger panel whereby the side edge fastening margins are doubled back upon themselves and are sealed throughout the length of the smaller panel. The portion of the larger panel against which the pouch apron end section is sealed may be considered to be an intermediate section of the sheet. A portion of the larger panel extends from the intermediate section beyond the smaller panel to form a foldable closure flap end section. The mutually adjacent portions of the larger and smaller panels at the demarcation therebetween and which are located interiorly from the side edge fastening margins are flattenable into a common plane to form the floor, while the remaining portions of the larger and smaller panels form the four walls and also form a pair of triangular shaped pockets that extend from the floor. This embodiment of the shipping container of the invention can thereby be transformed from a flattened pouch to a laterally expanded container by pressing the upper portions of the heat sealed fastening margins toward each other while pressing downwardly on the lower portions of the fastening margins.

The invention may be described with greater clarity and particularity by reference to the accompanying drawings.

DESCRIPTION OF THE EMBODIMENT

Figure 1:
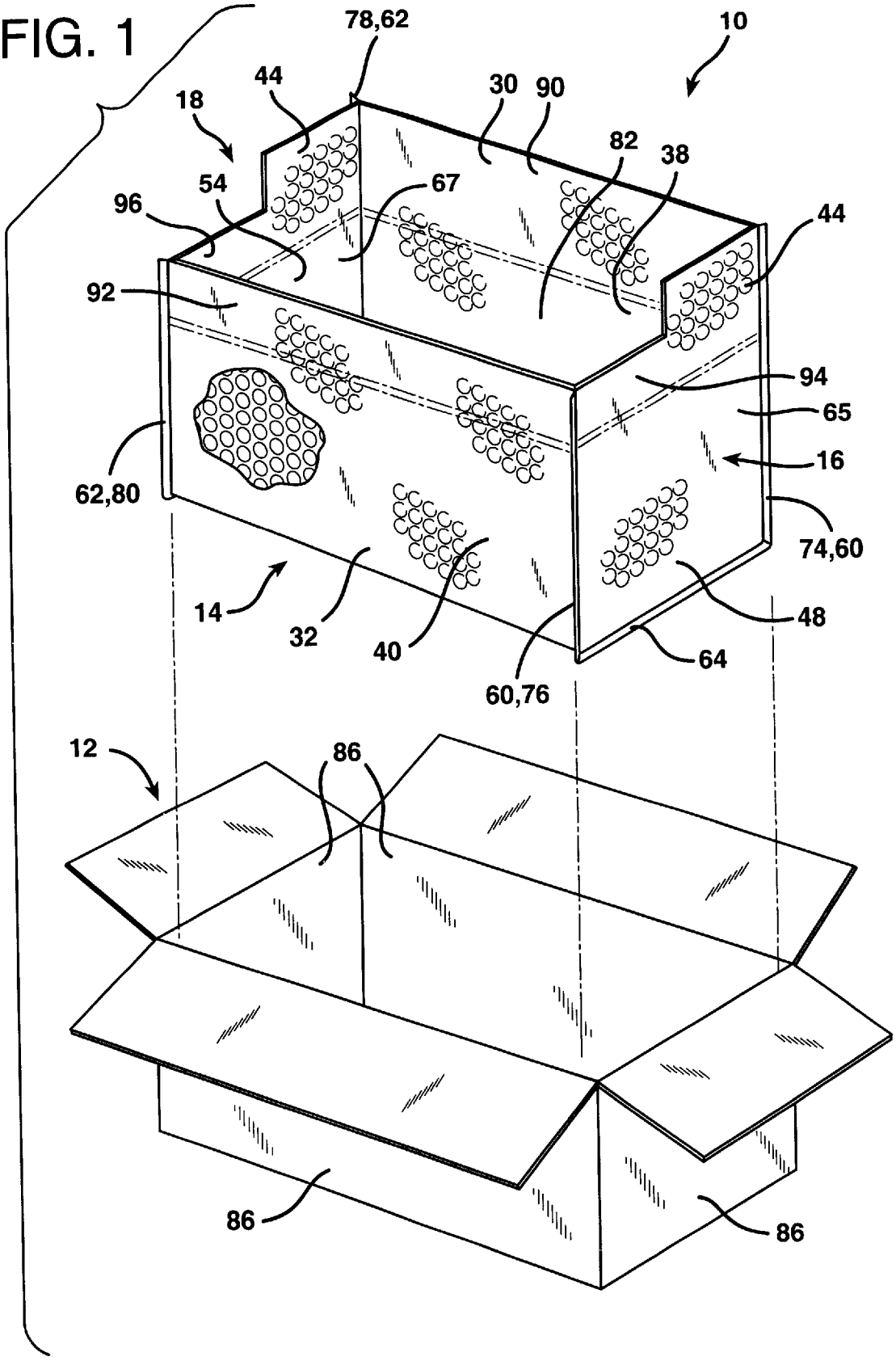
FIG. 1 is a perspective view illustrating a finished collapsible inner shipping container according to the invention formed of three sheets of flexible, thermally insulating material as used to package perishable goods within a conventional outer container.

FIG. 1 illustrates one embodiment of a fully collapsible shipping container 10 according to the invention constructed for use to fit closely within a conventional outer container 12, which is typically a corrugated paper board box having the shape of a rectangular prism. The shipping container 10 is constructed of a first elongated sheet 14, a second sheet 16 and a third sheet 18, shown prior to folding in FIG. 5. The second sheet 16 and the third sheet 18 are both shorter than the first elongated sheet 14.

Figure 2:
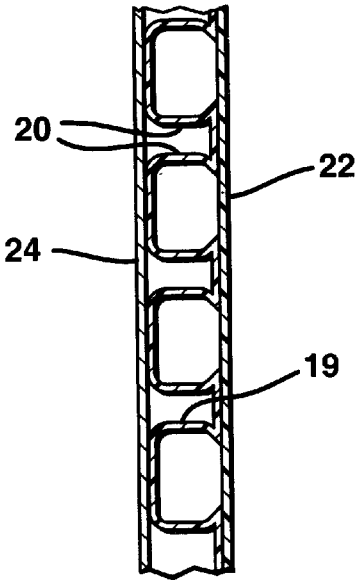
FIG. 2 is a cross-sectional detail of one form of the construction of a flexible, thermally insulating material used to form a collapsible shipping container according to the invention.

The three sheets 14, 16, and 18 are all formed of the same flexible, thermally insulating material. In one preferred construction of the container 10, sheets 14, 16 and 18 are formed as illustrated in FIG. 2. Specifically, they are each formed of plastic, white bubble packing material having a core layer 19 permanently deformed to define a multiplicity of disk-shaped, air filled bubbles 20. The core layer 19 that forms the bubbles 20 is faced on both sides with flat, thin plastic film layers 22 and 24 that are fused to the core layer 19 that forms the bubbles 20. The layers 19, 22 and 24 are all formed of polyethylene plastic fused together where they contact each other so that the bubbles 20 form resilient air filled, cushioning pockets. The sheet material formed by the layers 14, 16 and 18 may have a wall thickness of about one-eighth of an inch as measured between the outside surfaces of the inner layer 22 and the outer layer 24.

Figure 3:
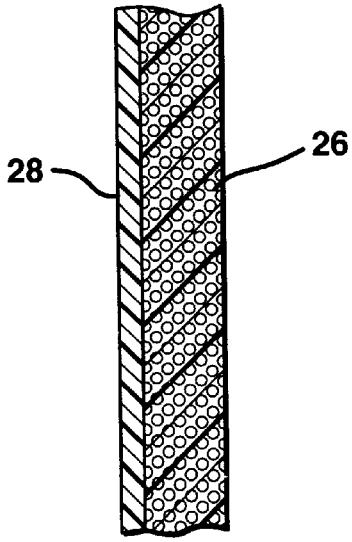
FIG. 3 is a cross-sectional detail of another form of the construction of a flexible, thermally insulating material used to form a collapsible shipping container according to the invention.

Alternatively, the sheets 14, 16 and 18 may be formed of a polyethylene or polyurethane foam layer 26 having a porous, resilient construction, faced upon one side with a thin polyethylene film 28 that is impervious to moisture. This construction is illustrated in FIG. 3. Both the sheet construction illustrated in FIG. 2 and the sheet construction illustrated in FIG. 3 are widely utilized in the packing industry and are conventional in nature.

Figure 5:
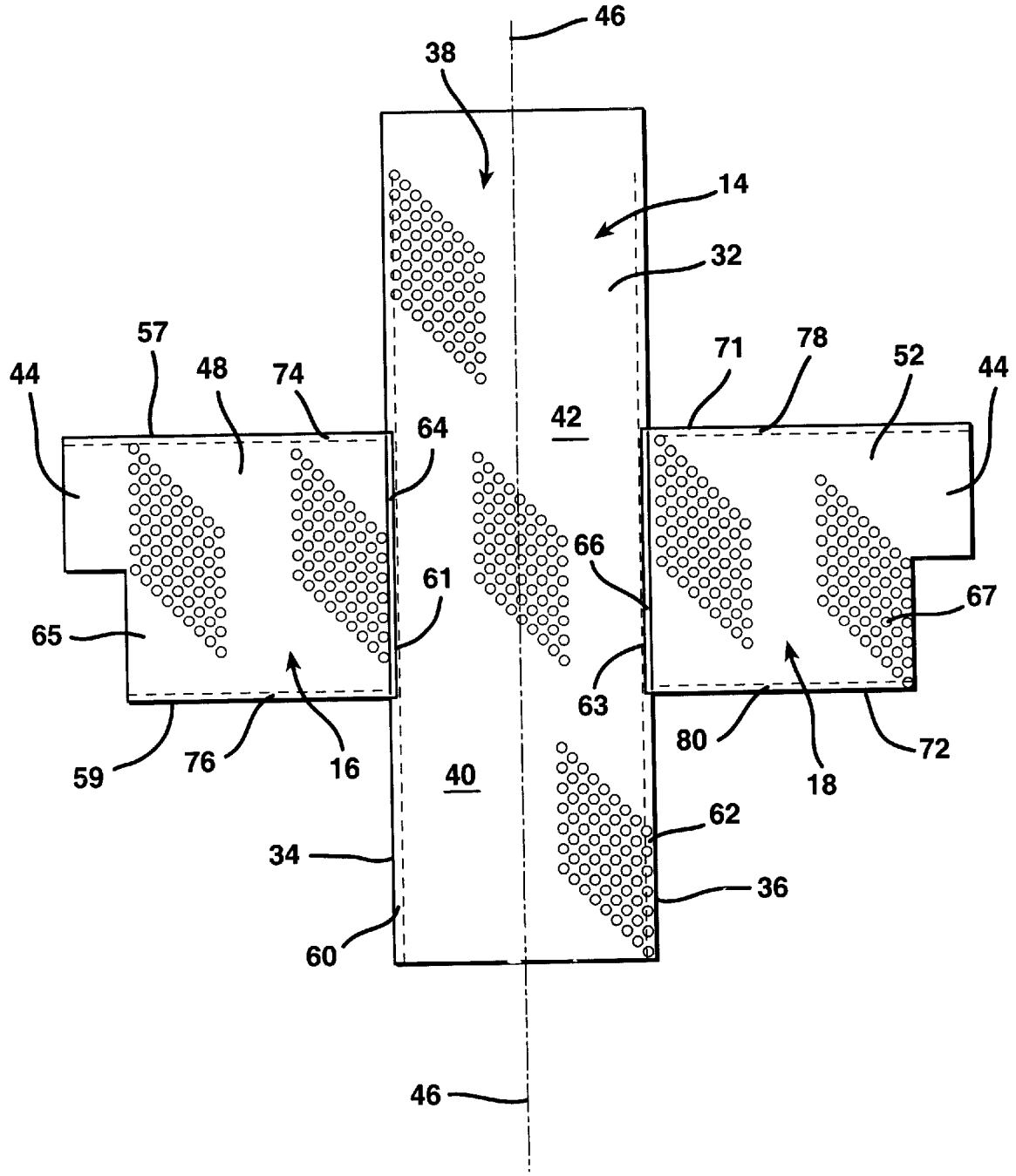
FIG. 5 is a plan view illustrating the sheets of material utilized to form the inner shipping container of FIG. 1 prior to heat sealing the side edge fastening margins.

The elongated sheet 14 has an outside surface 32, visible in FIG. 5, and an inside surface 30, visible in FIG. 1. The sheet 14 has opposing, mutually parallel side edges 34 and 36, respectfully, and mutually opposing outboard end sections 38 and 40 with a rectangular center section 42 located midway between the ends 38 and 40. The end sections 38 and 40 are in longitudinal alignment with each other and with the center section 42.

The second sheet 16 has an outside surface 48, visible in FIGS. 1 and 5, and an inside surface 50, indicated in FIGS.

Figure 7:
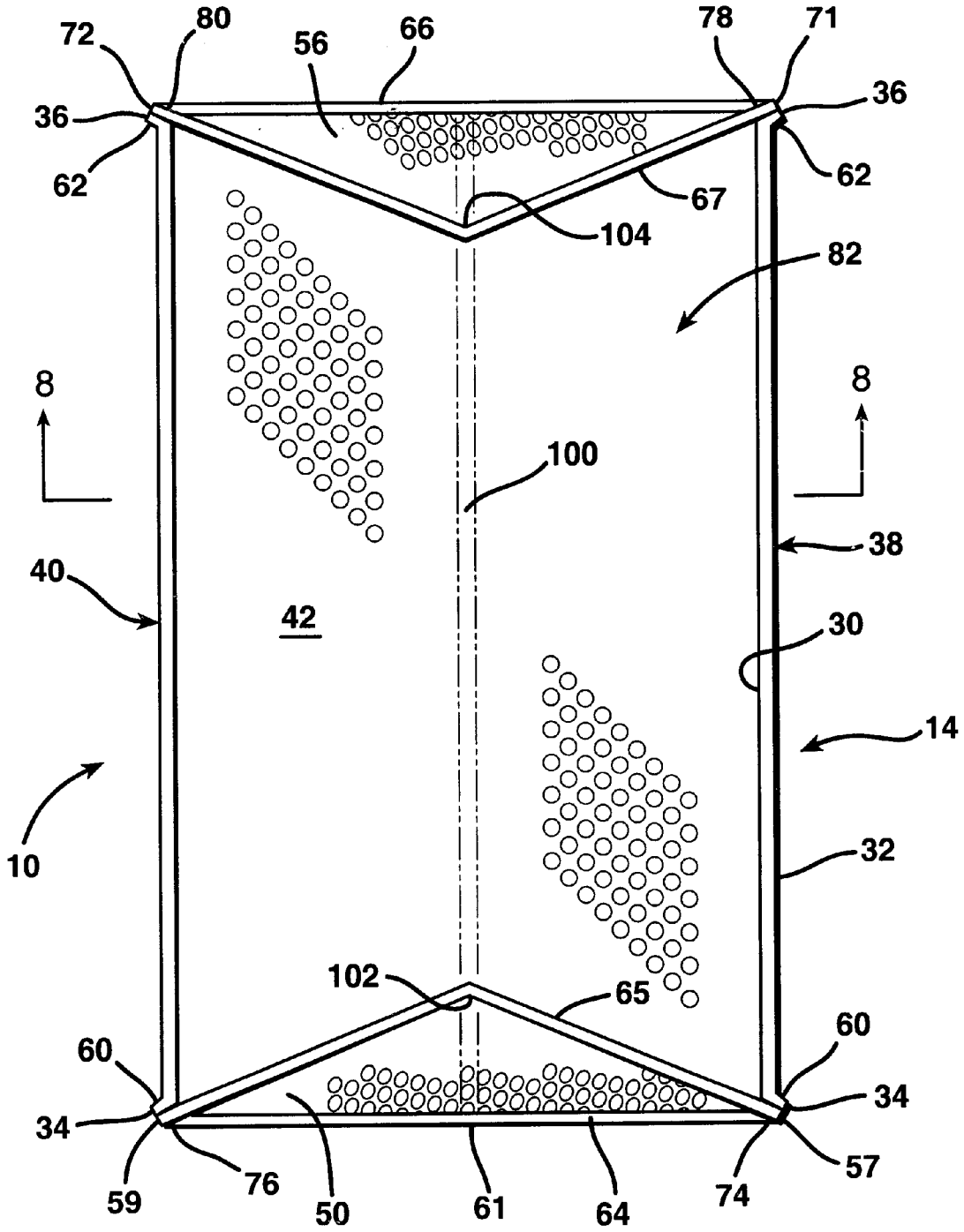
FIG. 7 is a top plan view of the inner shipping container of FIG. 1 at the commencement of folding for storage.
Figure 8:
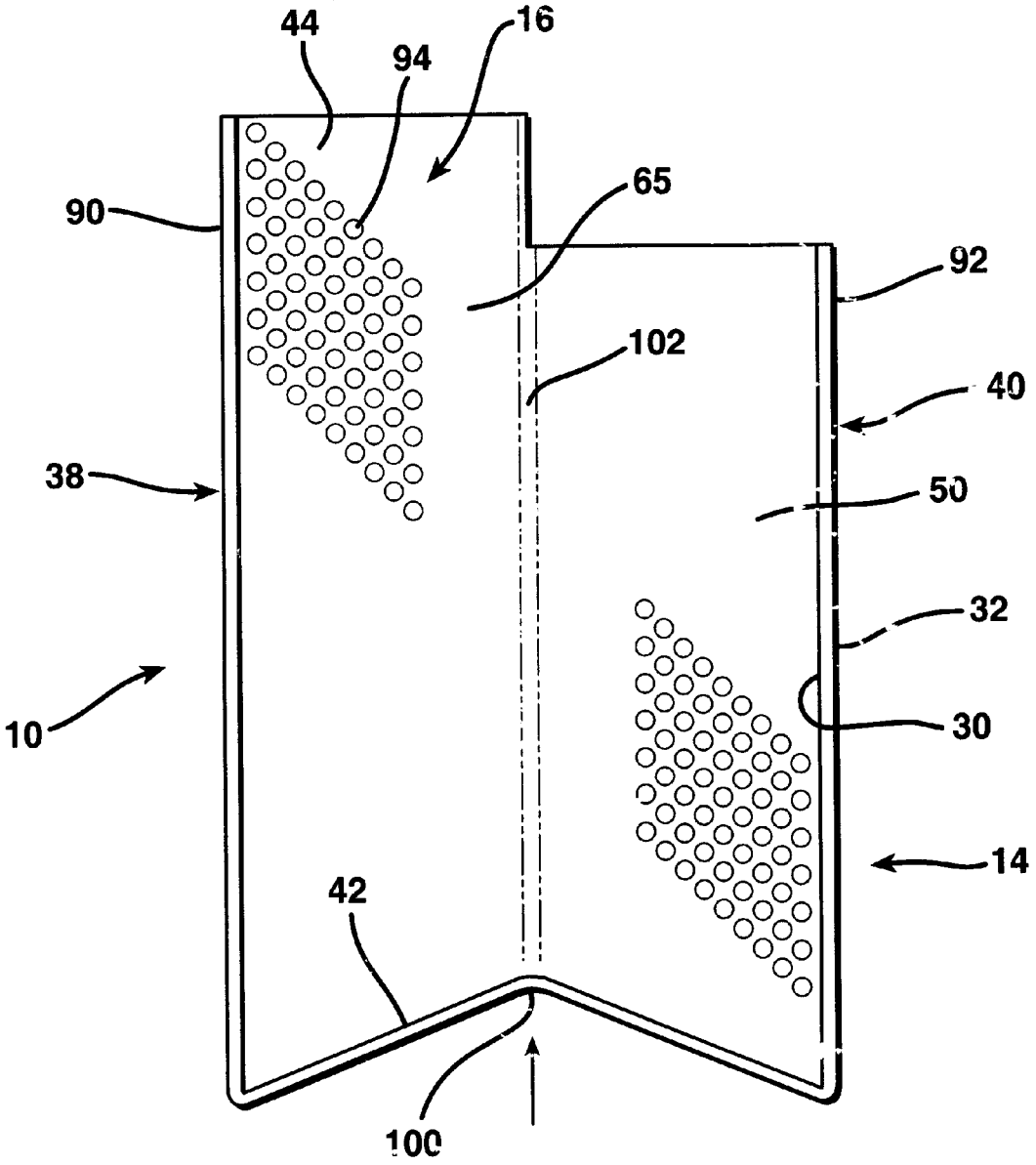
FIG. 8 is a sectional elevational view taken the along the lines 8—8 of FIG. 7.

6, 7, and 8. Likewise, the third sheet 18 has an outside surface 52, visible in FIG. 5, and an inside surface 54, indicated in FIGS. 6, 7, and 8.

The longitudinal side edges 34 and 36 of the elongated sheet 14 lie at the lateral extremities of mutually parallel linear side edge fastening margins which each have a width of about one quarter of an inch and are indicated at 60 and 62 in FIG. 5. The second sheet 16 projects from the center section 42 of the first side edge 34 of the first sheet 14. The inboard edge margin 64 of the second sheet 16 adjacent the inboard edge 61 thereof is secured by a moisture tight heat seal throughout its length to the center of the first side edge margin 60 so that the second sheet 16 extends perpendicularly outwardly from the center section 42 of the elongated sheet 14. The second sheet 16 and first sheet 14 thereby form mutually facing sealing margins 60 and 64 that ultimately project from the outside surfaces 32 and 48 of the first and second sheets 14 and 16, respectively. The second sheet 16 has side edges 57 and 59 that intersect the first side edge 34 of the first sheet 14 at right angles.

Similarly, the third sheet 18 has an inboard edge margin 66 and an opposing outboard end 67. The inboard edge margin 66 of the third sheet 18 adjacent the inboard edge 63 thereof is secured by a liquid tight heat seal throughout its length to the second longitudinal side edge margin 62 of the elongated sheet 14 at the center thereof. The first and third sheets 14 and 18 form mutually facing sealing margins that project from the outside surfaces 32 and 52 of the first and third sheets 14 and 18, respectively. The third sheet has side edges 71 and 72 that intersect the second side edge 36 of the first sheet 14 at right angles. The third sheet 18 thereby projects perpendicularly outwardly from the side edge margin 62 of the elongated first sheet 14 at the central section 42 thereof.

It is possible to construct the entire sheet structure forming the container 10 from a single sheet of stock. However, by utilizing the three sheet construction shown in FIG. 5 all three of the sheets 14, 16, and 18 can be cut from the same roll of sheet stock, thus minimizing any wastage of sheet material.

Prior to folding, the sheets 14, 16 and 18 form a cruciform in which the arm formed by the end section 38 of the first sheet 14 is longer than the arm formed by the other end section 40 as illustrated in FIG. 5. The extremities of the outboard ends 65 and 67 of the second sheet 14 and third sheet 18, respectively, are each cut in a step fashion to define a pair of rectangular end flaps 44.

Once the inboard edge margins 64 and 66 of the second and third sheets 16 and 18 have been heat sealed to the side edge margins 60 and 62, respectively, at the center section 42 of elongated first sheet 14, the second and third sheets 16 and 18 are folded ninety degrees about these sealed edges. The end sections 38 and 40 of the elongated first sheet 14 are likewise folded ninety degrees relative to the center section 42 from the planar orientation illustrated in FIG. 5. The center section 42 of the first sheet 14 then forms a floor of an enclosure 82 while the second and third sheets 16 and 18 and the ends 38 and 40 of the first sheet 14 form mutually perpendicular sets of mutually parallel opposing enclosure walls, as illustrated in FIGS. 1, 6, 7, and 8.

The side edge margins 74 and 76 of the second sheet 16 immediately adjacent to the side edges 57 and 59 thereof, respectively, are heat sealed throughout their lengths with the portions of the first side edge margin 60 of the first sheet 14 located adjacent thereto. The side edge margins 74 and 76 are sealed to the side edge margin 60 at the first sheet ends 38 and 40, respectively, with a moisture tight heat seal. Similarly, the side edge margins 78 and 80 of the third sheet 18 lying immediately adjacent to the longitudinal side edges 71 and 72 thereof are heat sealed throughout their lengths to the portions of the side edge margin 62 adjacent the second longitudinal side edge 36 of the first sheet 14.

Figure 6:
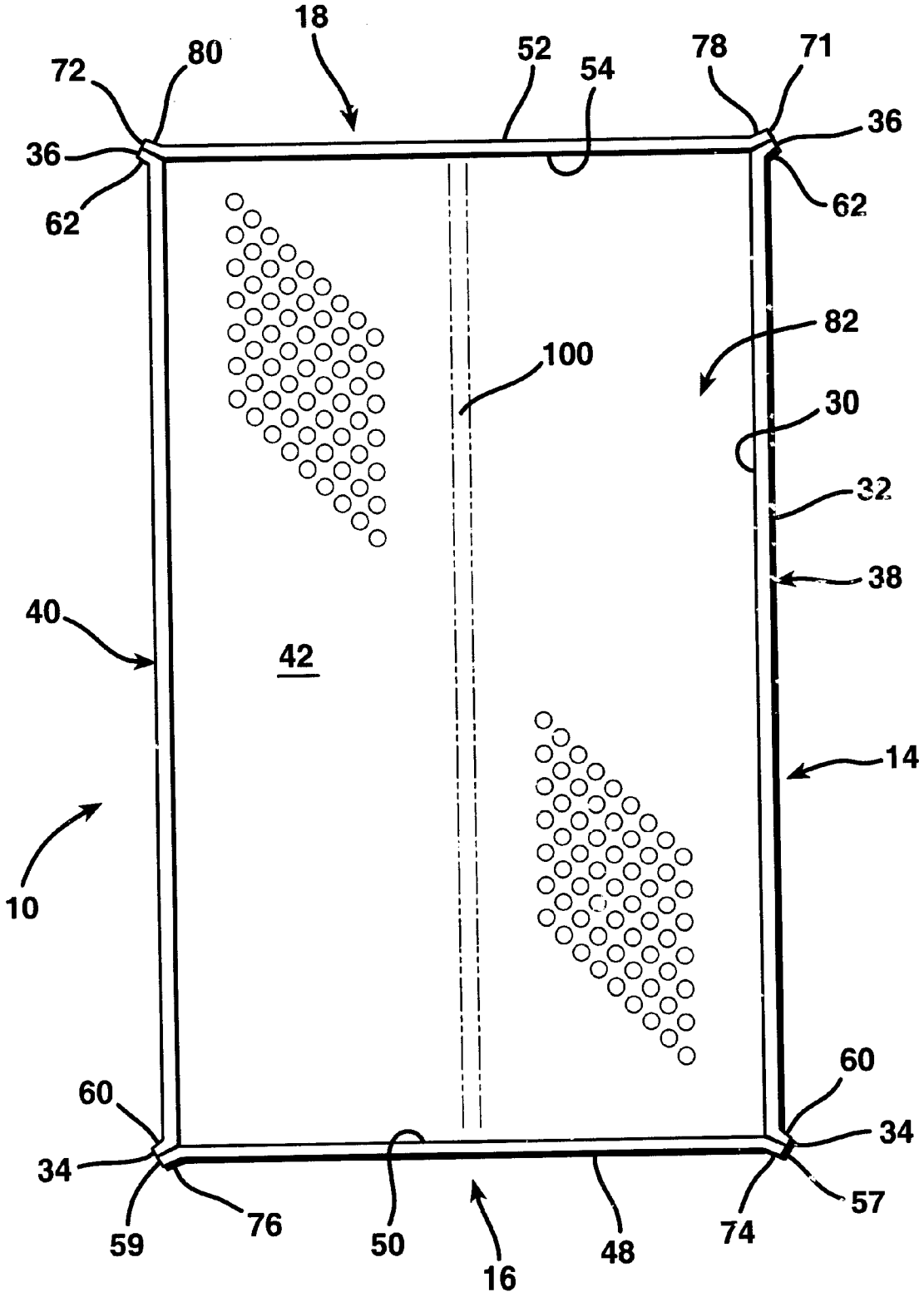
FIG. 6 is a top plan view of the inner shipping container shown in FIG. 1.

As best illustrated in FIGS. 1 and 6, the four walls project upwardly from the floor formed by the center section 42 in orthogonal relation relative thereto to define an enclosure 82. The linear side edge fastening margins 60, 62, 74, 76, 78, and 80 meet and are heat sealed throughout interfaces of mutual contact, as best shown in FIG. 6. The edge margins 60, 62, 74, 76, 78, and 80 are thereby directed outwardly from the exterior of the enclosure 82.

Figure 4:
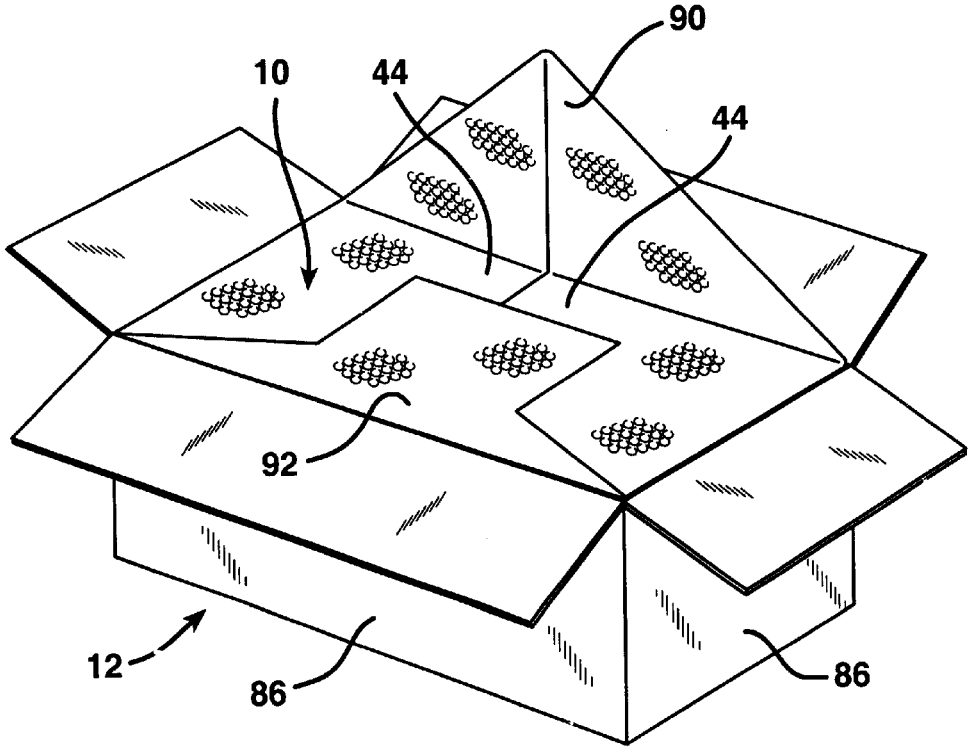
FIG. 4 is a perspective view illustrating the collapsible inner shipping container of FIG. 1 inserted into the conventional outer container and folded to encapsulate perishable goods therewithin.

The flexible, moisture impervious shipping container 10 is especially adapted for use as an inner container as illustrated in FIGS. 1 and 4. The size and shape of the shipping container 10 is such that it fits snugly down into the rectangular, paper board box 12. Specifically, the floor formed by the center section 42 of the shipping container 10 is of the same shape as the floor of the box 12 and is only very slightly smaller in size. The container walls formed by the ends 38 and 40 of the first sheet 14 and by the second and third sheets 16 and 18 extend somewhat above the height of the side walls 86 of the paper board box 12. However, the upper extremities 90 and 92 of the first sheet ends 38 and 40 and the upper extremities 94 and 96 of the outboard ends 65 and 67 of the second and third sheets 16 and 18, respectively, form closure flaps which are folded down over perishable food located within the container enclosure 82 in the manner illustrated in FIG. 4.

The end section 38 of the first sheet 14 is longer then the end section 40 in a direction perpendicular to the floor formed by the center section 42. As a consequence, the wall formed by the end section 38 projects further from the floor formed by the center section 42 than the wall formed by the end section 40 located opposite the end section 38. The upper portion 90 of the end section 38 thereby forms a closure flap that is longer than the closure flap formed by the upper extremity 92 of the end section 40. The closure flap 90 is thereby foldable over the upper portion 92 extending from the wall formed by the end section 40 located opposite to the wall formed by the end section 38. The closure flaps 90 and 92, together with the upper portions 94 and 96 of the second and third sheets 16 and 18, respectively, thereby cover and encapsulate the enclosure 82, in the manner illustrated in FIG. 4.

The heat sealed side edge margins at the intersections of the upright walls formed by the second and third sheets 16 and 18 and by the end sections 38 and 40 of the first sheet 14 prevent any leakage from the enclosure 82. The leak proof characteristics of the container 10 are far superior to those of conventional flexible shipping containers for perishable goods.

Figure 9:
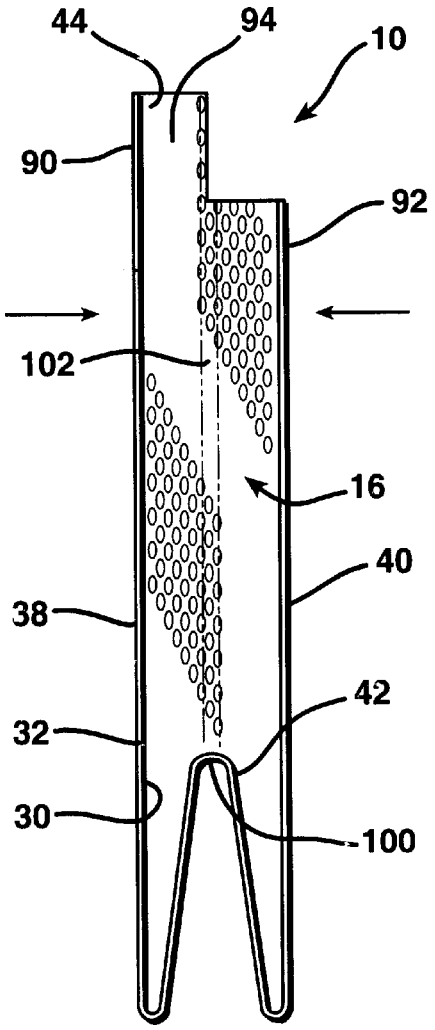
FIG. 9 is a sectional elevational view of the inner shipping container as shown in FIG. 8 being flattened for storage.

The flexible shipping container 10 is also readily collapsible for storage when not in use. As illustrated in FIGS. 6 through 9 the floor formed by the center section 42 of the first sheet 14 is foldable inwardly toward the enclosure 82 along a floor folding line 100 that bisects the floor formed by the central section 42 and extends between the walls formed by the second and third sheets 16 and 18. The second and third sheets 16 and 18 are both foldable inwardly toward the enclosure 82 along vertical wall folding lines 102 and 104 that are parallel to the side edge margins 74, 76, 78, and 80 of the second and third sheets 16 and 18. The vertical wall folding line 102 is parallel to and equidistant from the side edge margins 74 and 76 of the second sheet 16. Likewise, the vertical fold line 104 is parallel to and equidistant from the side edge margins 78 and 80 of the third sheet 18. As the container 10 is folded along the fold lines 100, 102, and 104 the floor formed by the central section 42 is foldable in half and the end sections 38 and 40 are collapsible into contact with each other as illustrated in FIGS. 9 and 10.

Figure 10:
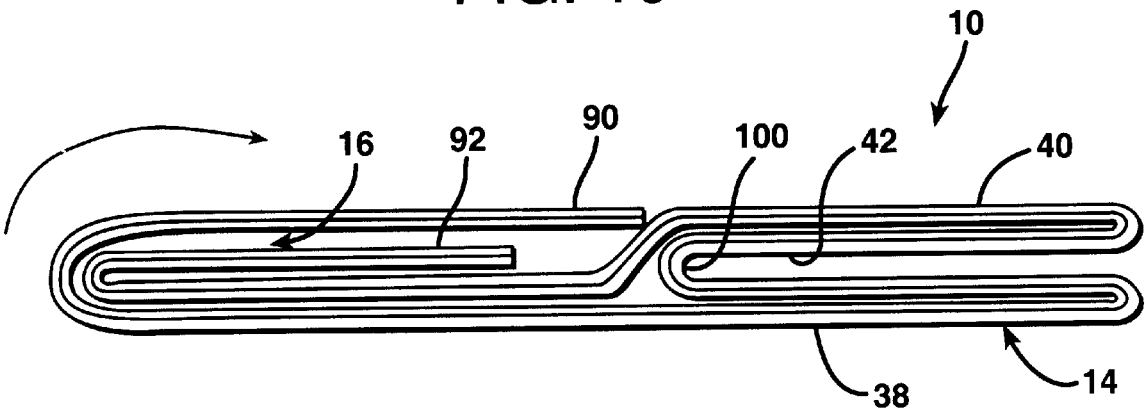
FIG. 10 is a sectional elevational view of the inner shipping container flattened completely and with the top flap folded over for storage.
Figure 11:
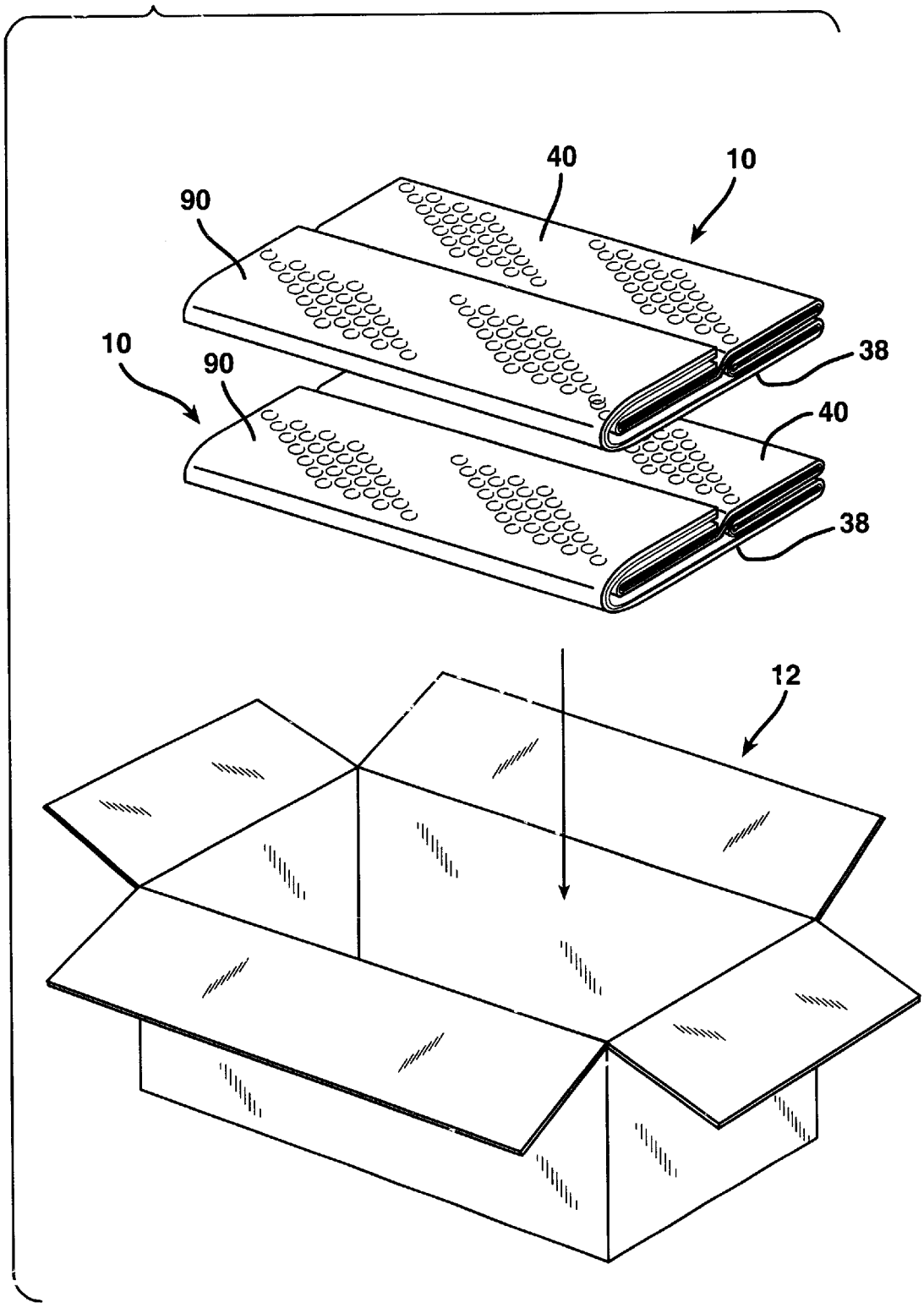
FIG. 11 is a perspective view illustrating the manner in which a large number of the inner shipping containers of FIG. 1 can be flattened as shown in FIG. 10 and stored.

Once the walls formed by the end sections 38 and 40 have been collapsed into contact with each other and the floor formed by the central section 42 folded in half, the top closure flap 90 of the container 10 is then folded over as illustrated in FIG. 10. Preferably, the folded floor formed by the center section 42 extends to approximately the middle of the folded structure from one direction, while the folded over flaps 90, 92, 94, and 96 extend to about the middle of the folded structure from the opposite direction as illustrated in FIG. 10. As a consequence, the number of plies of material of the folded container 10 on each side of the folded and completely collapsed structure are substantially equal. As a result, a large number of folded containers 10 can be stacked one atop another within one of the boxes 12 as illustrated in FIG. 11. Each folded storage container 10 is oriented parallel to the floor of the box 12 when a number of the collapsed containers 10 are stored in this manner. As a result, a very large number of folded containers 10 can be stacked within the box 12 while remaining level and mutually parallel to each other. This facilitates the storage of the containers when they are not in use.

Figure 12:
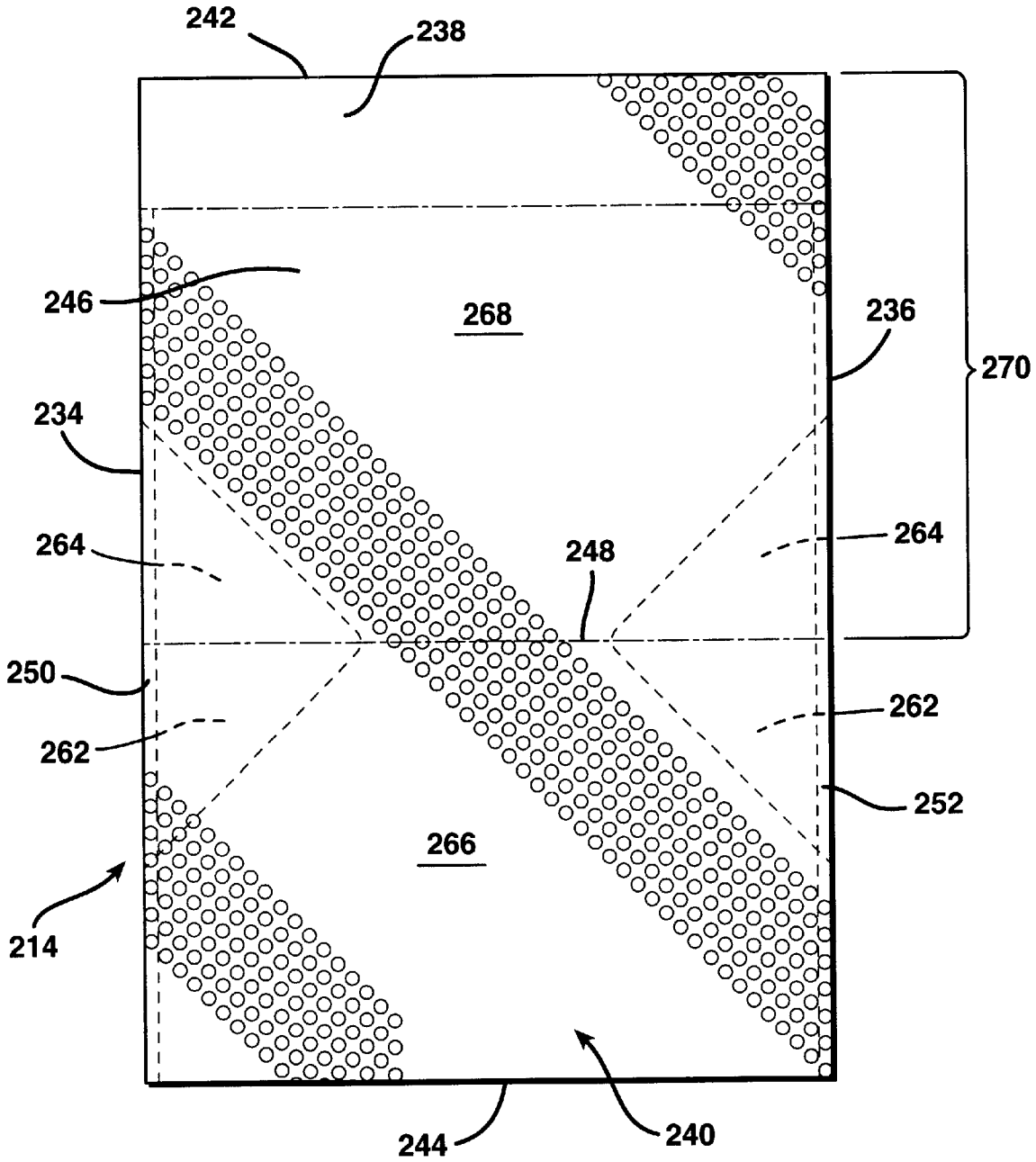
FIG. 12 is a top plan view of a single elongated rectangular sheet of flexible, thermally insulating material prior to forming an alternative embodiment of a collapsible shipping container according to the invention.
Figure 13:
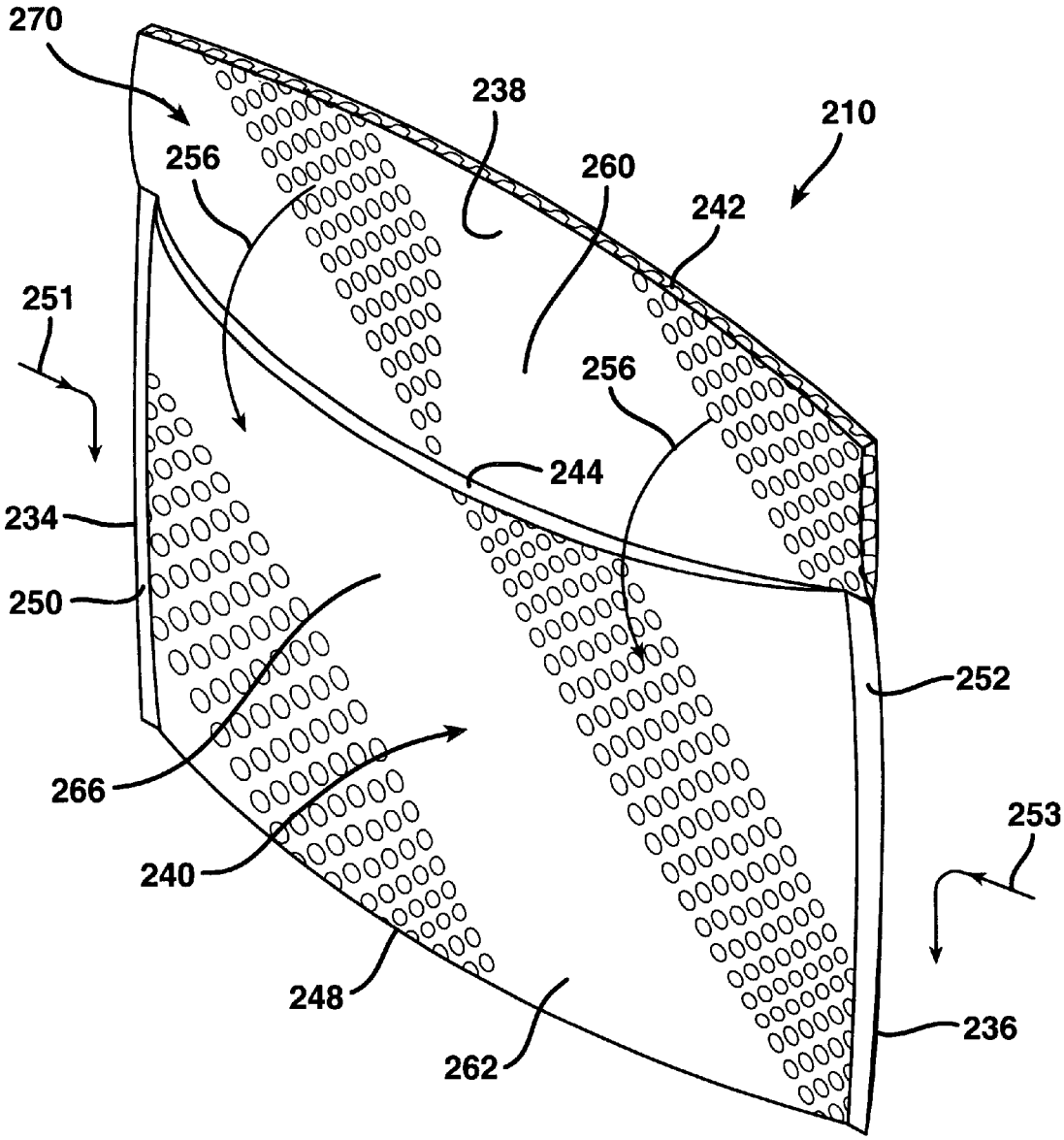
FIG. 13 is a perspective view of a completed shipping container according to the invention formed from the single sheet of material of FIG. 12.
Figure 14:
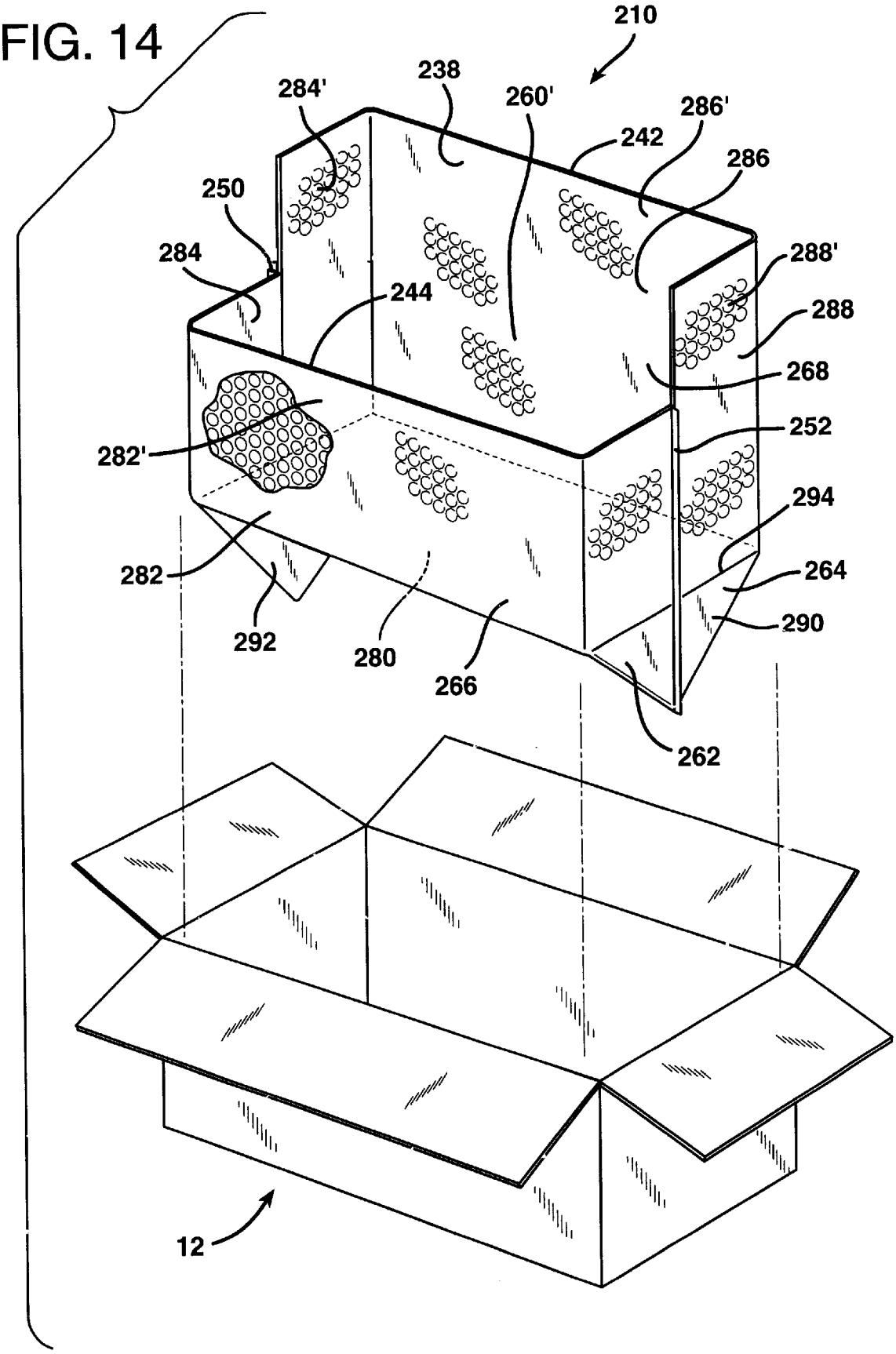
FIG. 14 is a perspective view illustrating the deployment of the shipping container shown in FIG. 13 for use in packaging perishable goods.

FIGS. 12, 13, and 14 illustrate a fully collapsible shipping container 210 comprised of a single rectangular expansive sheet 214 of flexible, thermally insulating sheet material constructed, for example, as depicted in FIG. 2 or FIG. 3. The sheet of material 210 has longitudinal side edges 234 and 236 and opposing end sections 238 and 240. The end sections 238 and 240 terminate in end edges 242 and 244 that are shorter than the side edges 234 and 236. The end edges 242 and 244 are perpendicular to the side edges 234 and 236. Side edge fastening margins 250 and 252 are located immediately adjacent the longitudinal side edges 234 and 236. The side edge margins 250 and 252 of the flexible shipping container 210 extend in the direction of the length of the container 214.

The sheet 214 forming the container 210 may be considered as being delineated into a larger panel 270 comprised of an intermediate section 246 and a flap end section 238 and a smaller panel 240 that serves as a pouch apron end section. The intermediate section 246 is equal in size to the pouch apron end section 240. The intermediate section 246 is located between the pouch apron end section 240 and the flap end section 238. The pouch apron end section 240 is foldable in a transverse direction along a fold line 248 back against the intermediate section 246 of the larger panel 270. The edge margins 250 and 252 immediately adjacent the longitudinal edges 234 and 236 of the sheet 214 at the pouch apron end section 240 and the intermediate section 246 are doubled back and sealed to themselves throughout the length of the smaller panel that forms the pouch apron end section 240.

The doubled back portions of the longitudinal edge margins 250 and 252 at the intermediate section 246 and at the pouch apron end section 240 are secured throughout their lengths by liquid tight heat seals, as illustrated in FIG. 13. As a consequence, the single sheet 214 is folded along the fold line 248 and sealed along its edges throughout the pouch apron end section 240 and the intermediate section 246 to form the flexible container 210. The structure of the container 210 forms a pouch 260 between the pouch apron end section 240 and the intermediate section 246.

As in the embodiment of FIGS. 1–11, the doubled back portions of the linear side edge fastening margins 250 and 252 meet in facing relationship and are heat sealed throughout interfaces of mutual contact. These side edge fastening margins 250 and 252 are directed outwardly from the exterior of the pouch like enclosure 260 as illustrated in FIG. 13. Also, the flap end section 238 forms a flap that folds over the end edge 244 of the pouch apron end section 240, as illustrated by the directional arrows 256 in FIG. 13.

Mutually adjacent portions 262 and 264 of the pouch apron end section 240 and the intermediate section 246 near both of the longitudinal side edges 234 and 236, indicated generally by the areas delineated by phantom lines in FIG. 13, are foldable toward each other and in a direction crossing the transverse direction of the fold line 248 when the upper portions of the sealed side edge margins 250 and 252 are pressed toward each other parallel to the transverse fold line 248 and downwardly, as indicated by the directional arrows 251 and 253 of force application, indicated in FIG. 13. The application of forces as indicated at 251 and 253 collapses the mutually adjacent portions 262 and 264 of the pouch apron end section 240 and the intermediate section 246 downwardly and toward each other, thereby forcing the remaining portion 266 of the pouch apron end section 240 and the remaining portion 268 of the intermediate section 246 of the material of the single sheet 214 away from each other. This expands the pouch 260 in a direction perpendicular to the longitudinal side edge margins 250 and 252, as illustrated in FIG. 14. As a consequence, the volume of the pouch 260 of the container 210 in the generally collapsed condition shown in FIG. 13 is greatly enlarged to form an expanded cavity 260' between the pouch apron end section 240 and the intermediate section 246 of the expanse of the sheet of material 214, as illustrated in FIG. 14.

The expanded cavity 260' has a volume substantially the same shape as the rectilinear cavity formed by the floor and walls of the box 12, but only slightly smaller. As a result, the container 210 can fit into the box 12, while closely following its contours. When the upper portions of the sealed side edge margins 250 and 252 are pressed in toward each other and a downward force is exerted on the lower portions of the sealed side edge margins 250 and 252, as indicated at 251 and 253 in FIG. 13, the generally flat pouch 210 shown in FIG. 13 is resiliently deformed into a more rectilinear structure as illustrated in FIG. 14.

As the forces indicated at 251 and 253 are applied, mutually adjacent portions of the larger panel 270 and the smaller panel forming the pouch apron end section 240 at the demarcation therebetween by the fold line 248 and which are located interiorly from the side edge fastening margins 250 and 252 are flattenable into a common plane to form a flat, nearly rectangular floor 280, indicated in FIG. 14. The remaining portions of the larger panel 270 and the smaller panel forming the pouch apron end section 240 form the four walls 282, 284, 286, and 288 of the expanded enclosure 260', and a pair of triangular shaped pockets 290 and 292 that extend either downwardly or laterally outwardly from the floor 280. When the container 210 is lowered into the box 12, as illustrated in FIG. 14, these triangular shaped pockets 290 and 292 fold upwardly about fold lines 294 to extend in a vertical orientation outside of the container walls 284 and 288, but within the confines of the ends of the box 12.

Figure 16:
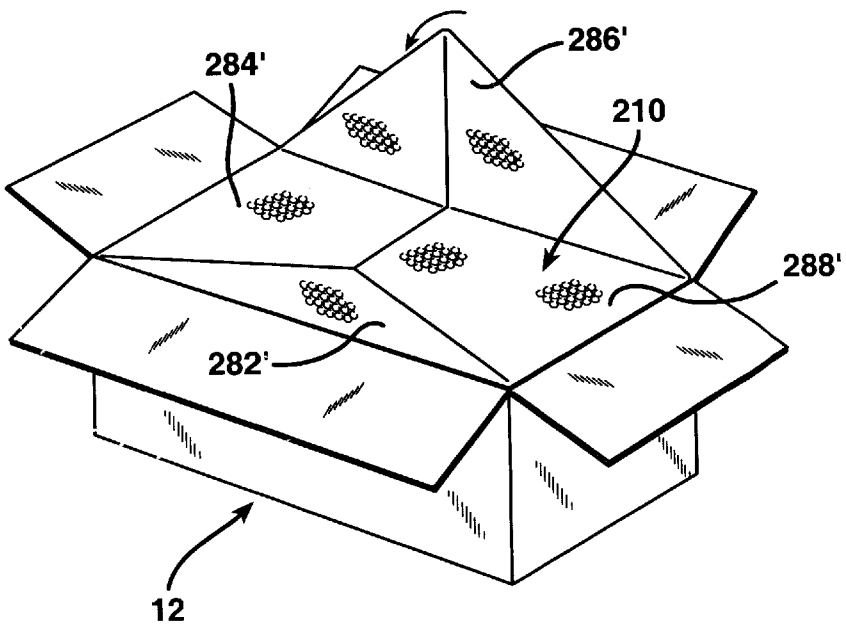
FIG. 16 is a perspective view of the flexible shipping container in the box of FIG. 15 at a subsequent stage of closure.
Figure 15:
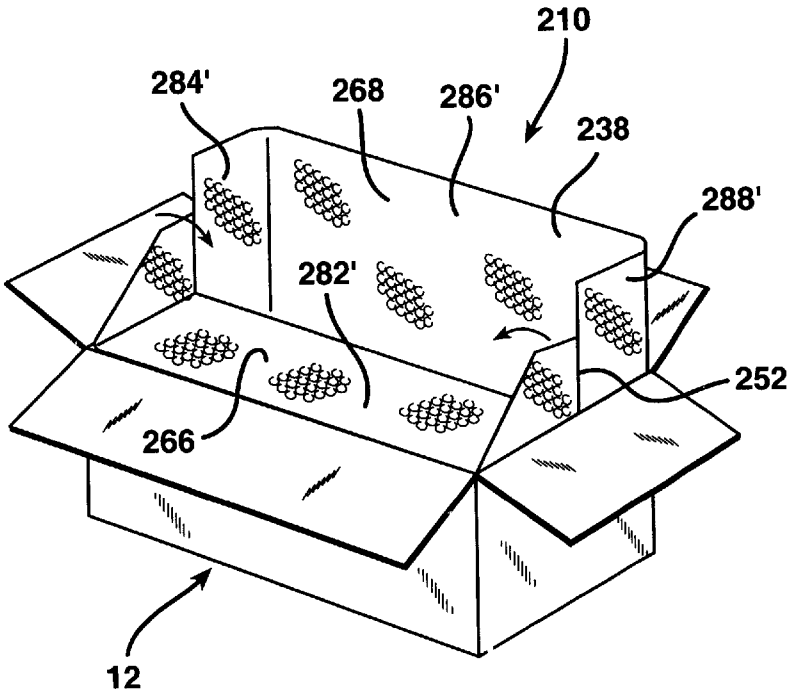
FIG. 15 illustrates the flexible shipping container shown in FIG. 14 fully inserted into an outer, conventional corrugated paper board box container and partially folded to cover the perishable goods to be shipped therein.
Figure 17:
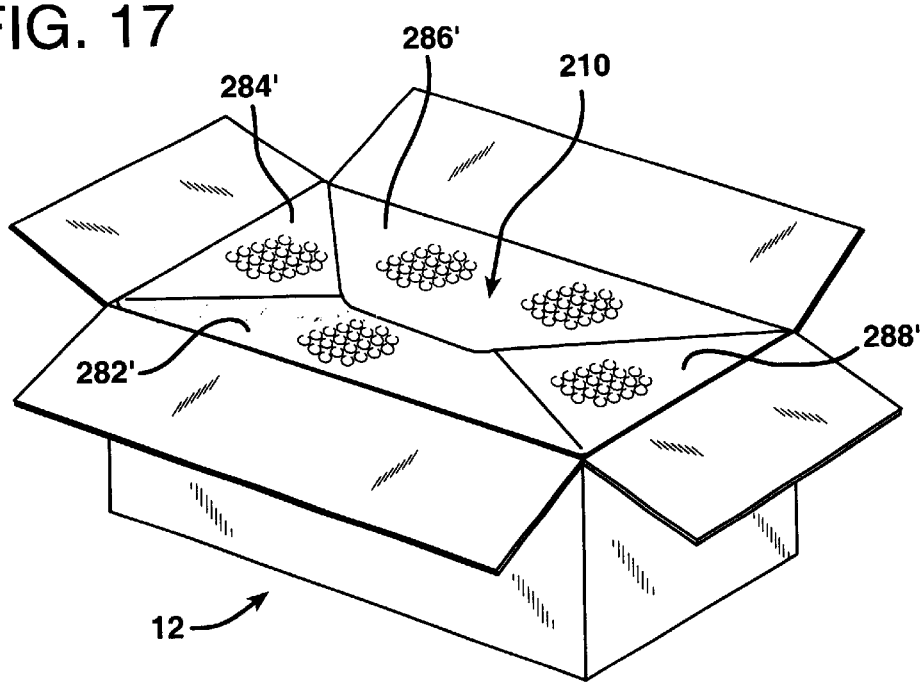
FIG. 17 is a perspective view of the flexible shipping container in the box of FIG. 15 at a final stage of closure to encapsulate perishable goods therewithin.

A portion of the larger panel 270, namely the small end section 238, extends beyond the smaller panel forming the pouch apron end section 240. The end section 238 thereby forms a top closure flap for the container 210. Once the container 210 has been placed in the box 12 as illustrated in FIG. 15, perishable goods are placed within the expanded enclosure 260'. The upper portions 282', 284', 286' and 288' of the upright container walls 282, 284, 286, and 288, respectively, are then folded down in the manner illustrated in FIGS. 15, 16, and 17 to encapsulate the perishable food products within the container 210. These products are thereby maintained completely enclosed within the leak proof container 210 so that freshness is preserved.

Figure 18:
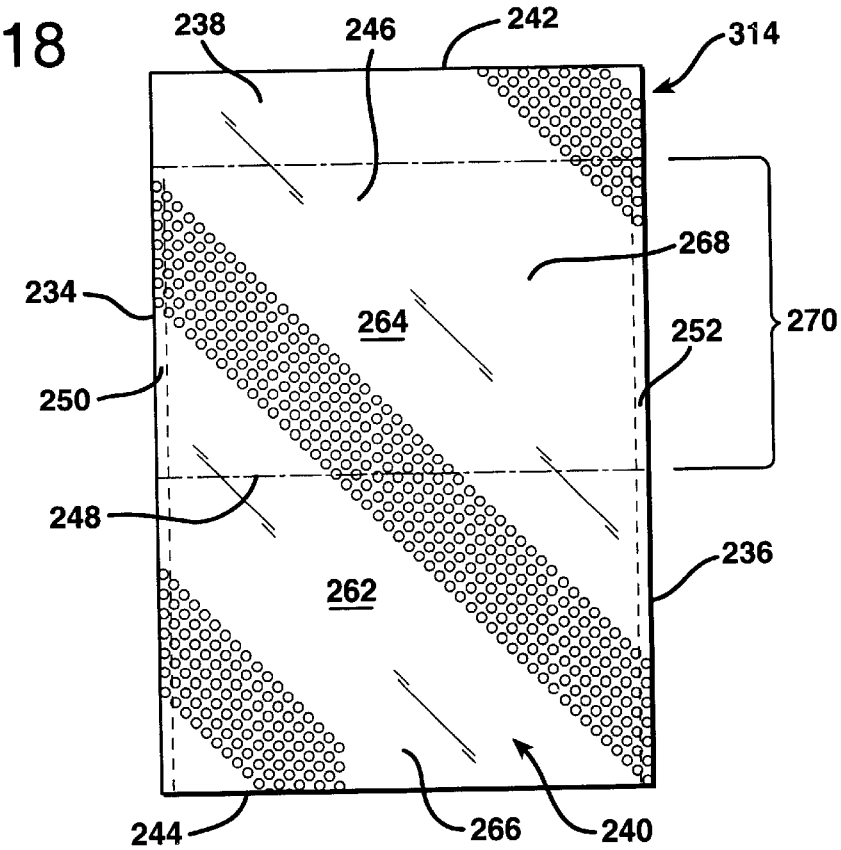
FIG. 18 is a plan view of a single sheet of thermally insulating material similar to that shown in FIG. 12 but faced on its outside surface with metallic, reflective material.
Figure 19:
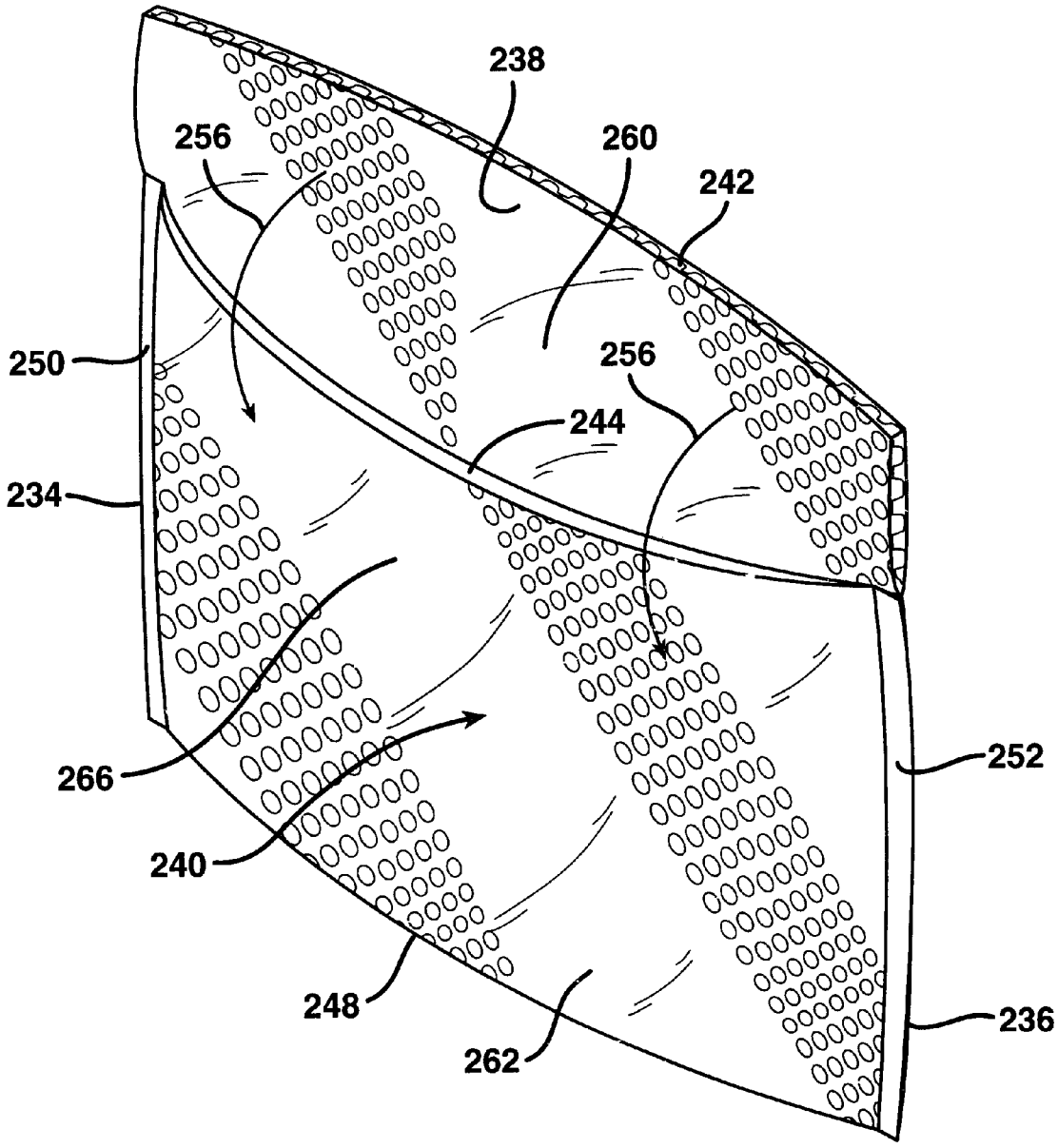
FIG. 19 is a perspective view of an embodiment of the invention similar to that shown in FIG. 13 but constructed of the sheet of material shown in FIG. 18.
Figure 20:
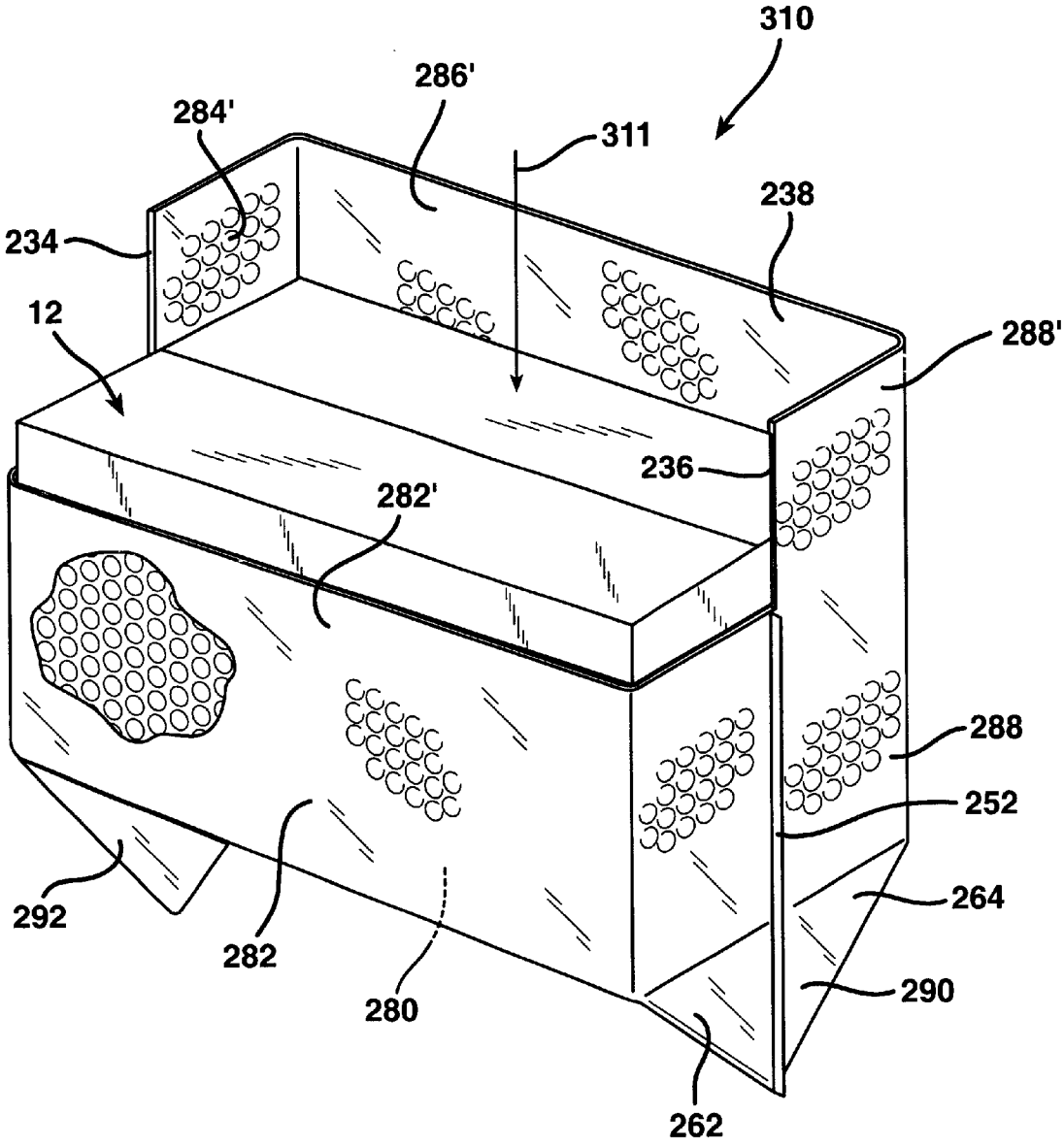
FIG. 20 illustrates the shipping container shown in FIG. 19 used as an outer container for an inner, conventional corrugated paper board box containing perishable goods.

FIGS. 18 through 20 illustrate a further alternative embodiment of a flexible container 310 according to the invention. The container 310 is identical to the container 210 in most respects, and identical component parts and elements of the container 310 are numbered with the corresponding reference numbers used in the description of the container 210. The container 310 differs from the container 210 in the material of which it is constructed and in its manner of use.

The container 310 is constructed of a single sheet of plastic bubble packing material 314 constructed as shown in FIG. 2 with the exception that the film 24 forming the outer, exposed surface of the container sheet material is formed of a metallic, reflective material, such as reflective polyethylene plastic. This reflective coating on the outer surface of the container 310 is useful to reflect light that falls upon the container 310. This is important considering the manner of use of the container 310.

As shown in FIG. 20, the container 310 is not utilized as an inner liner for a corrugated paperboard box 12, but rather as an outer, encapsulating container into which the corrugated box 12 fits. As shown in FIG. 20, the box 12 is inserted into the container 310 from its opened top, as indicated by the directional arrow 311. The insertion of the box 12 into the pouch like enclosure 260 of the container 310 forces the upper portions 266 and 268 of the panels 270 and 240 located interiorly from the side edge fastening margins 250 and 252 apart from each other. At the same time, the insertion of the box 12 into the container opening causes the portions 262 and 264 of the container material to flatten as the walls 282, 284, 286, and 288 assume a rectilinear shape.

Figure 21:
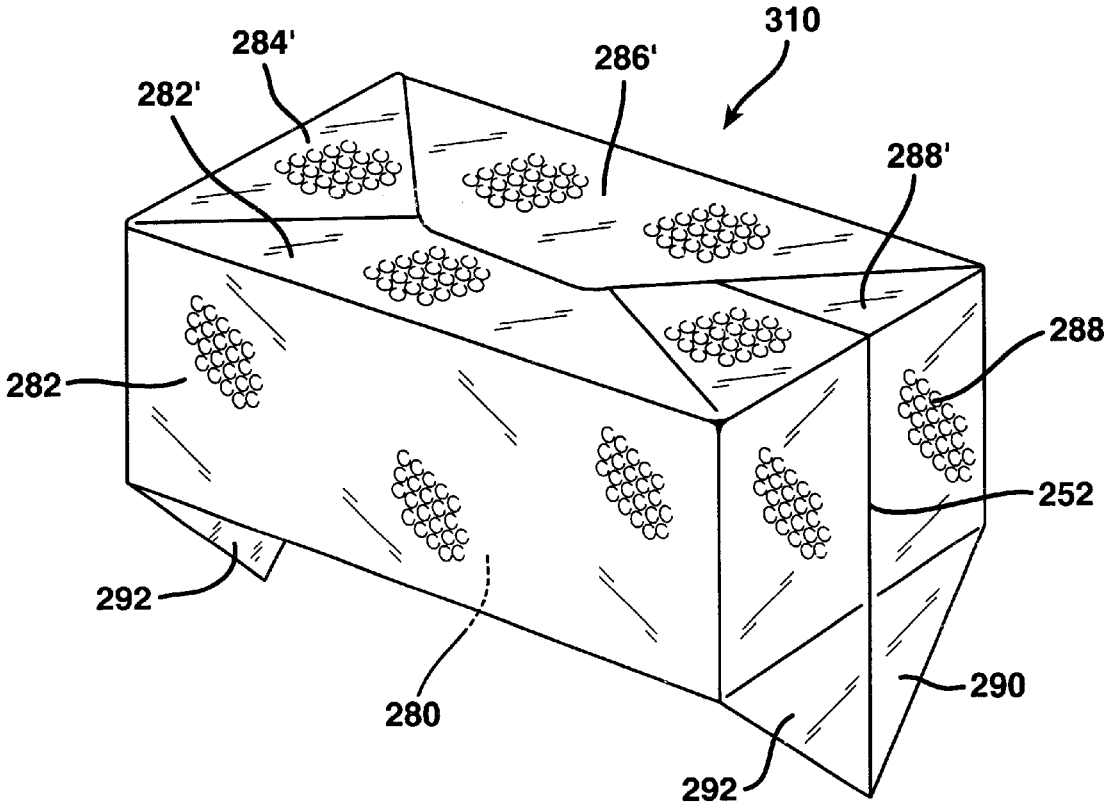
FIG. 21 illustrates the shipping container according to the invention utilized as depicted in FIG. 20 totally encapsulating a corrugated paper board box containing perishable goods.
Figure 22:
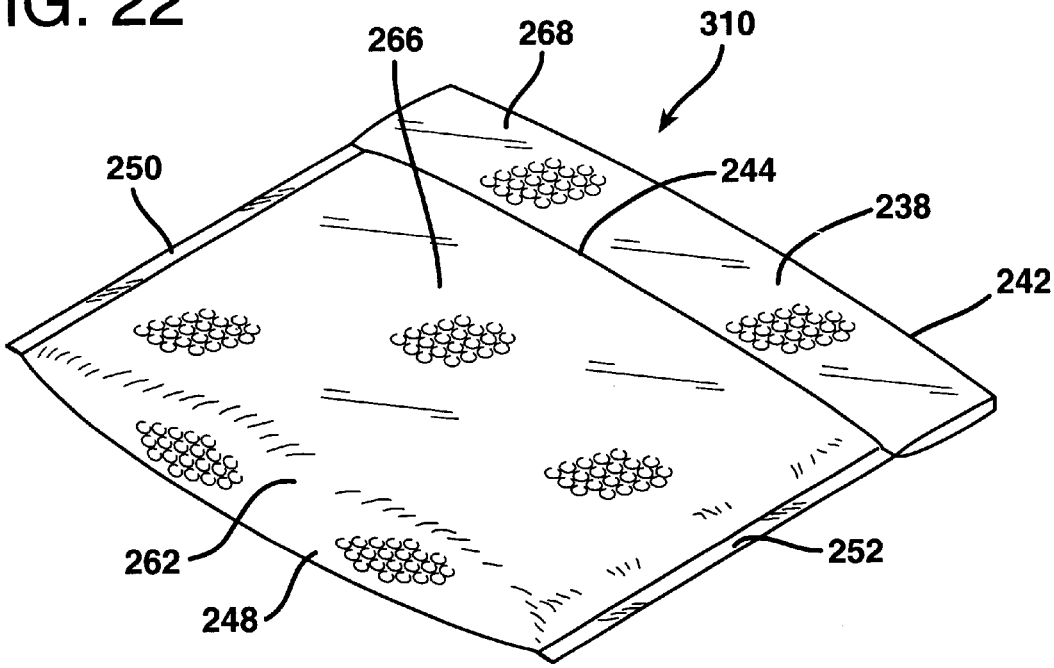
FIG. 22 is a perspective view of the shipping container shown in FIG. 19 flattened for storage.

As with the container 210, triangular shaped pockets 290 and 292 are formed in the container 310 at the opposite ends of the floor 280. The pockets 290 and 292 are delineated from the upright walls 284 and 288 by fold lines 294. The upper portions 282', 284', 286', and 288' of the upright walls 282, 284, 286, and 288 are then folded over the top of the box 12 in the manner illustrated in FIG. 21. Perishable food products are thereby hermetically encapsulated in the box 12 within the enveloping confines of the leak proof container 310. The reflective polyethylene surface on the exterior of the container 310 reflects light from the outer surface of the container 310 thereby enhancing the thermal insulating properties of the container 310.

Undoubtedly, numerous variations and modifications of the invention will become readily apparent to those familiar with containers for shipping perishable food products. For example, any number of sheets of material can be joined together to form the container of the invention. These containers may be fabricated from a number of different flexible, thermally insulating, water impervious sheet materials other than those specifically described. Accordingly, the scope of the invention should not be construed as limited to the specific embodiments depicted and described.

I claim:

1. A collapsible shipping container comprising first, second, and third sheets of flexible, thermally insulating material having mutually parallel linear side edge fastening margins, and said first sheet has an elongated shape and mutually opposing end sections with a center section located therebetween, and said second and third sheets of material are shorter than said first sheet and both have bottom attachment edge margins that are heat sealed to opposing ones of said side edge margins of said first sheet at said center section thereof and said side edge margins of said second and third sheets extend perpendicular to said side edge margins of said first sheet, and said sheets are folded to form a rectangular floor and four walls projecting from said floor in orthogonal relation relative thereto to define an enclosure, and said side edge margins of said second and third sheets meet in facing relationship and are heat sealed to said side edge margins of said first sheet which together form the aforesaid linear side edge fastening margins which are sealed throughout interfaces of mutual contact, whereby said side edge margins are directed outwardly from the exterior of said enclosure, and whereby said end sections of said first sheet and said second and third sheets form said four walls and said center section of said first sheet forms said floor.

2. A shipping container according to claim 3 further characterized in that at least one of said walls projects further from said floor than another of said walls located opposite thereto, thereby forming a closure flap, and said closure flap is foldable over a portion of said wall located opposite thereto to cover said enclosure.

3. A collapsible shipping container according to claim 1 wherein said floor is foldable inwardly toward said enclosure along a floor folding line that bisects said floor and extends between said second and third sheets, and said second and third sheets are both foldable inwardly toward said enclosure along wall folding lines that are parallel to said side edge margins of said second and third sheets and which are equidistant therefrom, whereby said floor is foldable in half and said end sections of said first sheet are collapsible into contact with each other.

4. A collapsible shipping container according to claim 3 wherein one of said end sections of said first sheet is longer than the other end section of said first sheet and thereby forms a flap that folds over a portion of said other end section.

5. A collapsible shipping container according to claim 1 wherein all of said sheets of material are formed of plastic bubble packing material faced on both sides with plastic film layers.

6. A collapsible shipping container according to claim 1 wherein said sheets of material are each formed of a plastic foam layer faced on one side with a plastic film layer.

7. A collapsible shipping container comprising:

a first elongated sheet of flexible, thermally insulating material having inside and outside surfaces and mutually parallel opposing first and second side edges and also having mutually opposing outboard ends and a center therebetween in longitudinal alignment with each other, a second sheet of flexible, thermally insulating material having inside and outside surfaces and projecting from the center of said first one of said side edges of said first sheet and wherein said second sheet has side edges that intersect said first one of said side edges of said first sheet, whereby said second sheet has opposing inboard and outboard ends, and said inboard end of said second sheet is secured by a moisture tight heat seal across its extremity to said center of said first of said side edges of said first sheet, thereby forming mutually facing floor sealing margins that project from said outside surfaces of said first and second sheets, and a third sheet of flexible, thermally insulating material having inside and outside surfaces and projecting from the center of said second one of said side edges of said first sheet and wherein said third sheet has side edges that intersect said second side edge of said first sheet, whereby said third sheet has opposing inboard and outboard ends, and said inboard end of said third sheet is secured by a moisture tight heat seal across its extremity to said center of said second side edge of said first sheet, thereby forming mutually facing floor sealing margins that project from said outside surfaces of said first and third sheets, and all of said outboard ends of said sheets are folded up from said center of said first sheet, and said side edges of said first sheet at said ends thereof are secured with moisture tight seals throughout to said side edges of said second and third sheets, thereby forming mutually facing wall sealing margins that project from said outside surfaces of said first, second, and third sheets, and whereby said center of said first sheet forms an enclosure floor, and said second and third sheets and said ends of said first sheet form mutually perpendicular sets of opposing enclosure walls, and said center of said first sheet is foldable in half inwardly so that said floor of said enclosure folds upwardly and inwardly and said walls in one of said sets of enclosure walls are foldable inwardly so that said walls in said other set of enclosure walls collapse toward each other and into contact with each other.

8. A collapsible shipping container according to claim 7 wherein all of said sheets are formed of plastic bubble packing material faced on both sides with plastic film layers.

9. A collapsible shipping container according to claim 7 wherein all of said sheets are formed of a layer of plastic foam insulation lined on one side with a plastic film.

* * * * *